US006789700B1

(12) United States Patent
Arniotis et al.

(10) Patent No.: US 6,789,700 B1
(45) Date of Patent: Sep. 14, 2004

(54) DISPENSER APPARATUS FOR SQUEEZABLE AND COLLAPSIBLE TUBES

(76) Inventors: James Dimitrios Arniotis, 66 San Vito Drive, Woodbridge, Ontario (CA), L4H 1X4; David Cescolini, 31 Queen Isabella Crescent, Maple, Ontario (CA), L6A 3J7

( * ) Notice: Subject to any disclaimer, the term of this patent is extended or adjusted under 35 U.S.C. 154(b) by 0 days.

(21) Appl. No.: 10/389,999

(22) Filed: Mar. 18, 2003

(51) Int. Cl.[7] ..... B65D 35/22

(52) U.S. Cl. ..... 222/94; 222/95; 222/99; 222/105; 222/181.1

(58) Field of Search ..... 222/94–96, 92, 222/98–102, 104–105, 107, 160, 132, 386, 181.1, 181.2, 181.5, 181.3

(56) References Cited

U.S. PATENT DOCUMENTS

| | | | | | |
|---|---|---|---|---|---|
| 1,692,116 | A | * | 11/1928 | Greist | 222/94 |
| 1,840,595 | A | * | 1/1932 | Moore | 222/132 |
| 3,029,983 | A | * | 4/1962 | Wagenhals | 222/94 |
| 3,701,459 | A | | 10/1972 | Ward | |
| 3,908,863 | A | | 9/1975 | White | |
| 3,910,460 | A | | 10/1975 | Hausmann et al. | |
| 3,915,342 | A | | 10/1975 | Van Bussel | |
| 4,019,655 | A | * | 4/1977 | Moeller | 222/96 |
| 4,271,985 | A | | 6/1981 | Andersen | |
| 4,418,840 | A | | 12/1983 | Gardner, Sr. | |
| 4,607,763 | A | | 8/1986 | Wright | |
| 5,044,522 | A | * | 9/1991 | Roig et al. | 222/108 |
| 5,105,984 | A | | 4/1992 | Kazimir | |
| 5,277,332 | A | * | 1/1994 | Rogers | 221/96 |
| 5,711,455 | A | | 1/1998 | Elliott | |
| 5,957,334 | A | | 9/1999 | Rosario | |
| 6,454,133 | B1 | * | 9/2002 | Lopez et al. | 222/102 |

FOREIGN PATENT DOCUMENTS

FR 2609002 A3 * 12/1987 ..... B65D/83/06

* cited by examiner

*Primary Examiner*—David A. Scherbel
*Assistant Examiner*—Frederick C. Nicolas
(74) *Attorney, Agent, or Firm*—Marks & Clerk

(57) ABSTRACT

A dispenser apparatus for use to dispense a material from a squeezable and collapsible tube is provided. The dispenser apparatus comprises a housing unit having a storage portion at the top end, a dispensing portion at the bottom end, and at least one channel which extends vertically from the top end to the bottom end. The dispenser also includes a feeder plate which is downwardly sloping from the storage portion to the dispensing portion, and a dispensing member above the feeder plate. When the dispensing member is in an open position, passage of one tube from the storage portion to the dispensing portion is permitted, and when the dispensing member is in a closed portion, passage of any tube into the dispensing portion is precluded. When in the dispensing portion, material can be dispensed from the tube, and thus converted the full tube to a collapsed, empty shape. Only when the tube has taken on the collapsed empty shape, is the tube removable from the dispensing portion. A device for reducing theft or other loss of the incompletely used tubes results.

21 Claims, 3 Drawing Sheets

DISPENSER APPARATUS FOR SQUEEZABLE AND COLLAPSIBLE TUBES

FIELD OF THE INVENTION

This invention relates to dispensers, and more particularly to dispensers for use to progressively dispense a material from a squeezable and collapsible tube.

1. Background of the Invention

Dispenser apparatuses for dispensing paste products from squeezable and collapsible tubes have been known for many years. The purpose of such devices is to allow the user to completely dispense all the paste products contained in the squeezable and collapsible tube without having to manually squeeze the tube since this action can be both physically exerting and/or dexterously challenging to some individuals. Further, it can also typically be very difficult for a user to completely dispense all the paste products from the tube solely by squeezing the tube between his or her fingers. As such, by using a dispenser apparatus, less of the paste product is wasted.

In many instances, dispenser apparatuses of this type are found in such places as lavatories, kitchens, and restaurants. Such dispenser apparatus are adapted to progressively empty the paste, toothpaste, cream or commercial paste content from a squeezable and collapsible tube through a threaded tube discharge mouth or spout, which mouth or spout is normally sealed by a separate cap.

A number of dispenser apparatuses are available on the market. These are typically structured in such a manner that the dispenser apparatus accommodates one squeezable and collapsible tube at a single time. The squeezable and collapsible tube is held in the dispenser apparatus in an inverted position with the discharge mouth of the tube commonly facing downwardly. After removal of the sealed cap at the discharge mouth, pressure is applied to the sealed end of the squeezable and collapsible tube so as to force the paste material to, and through, the open end of the tube, and thus be dispensed from the squeezable and collapsible tube.

Notwithstanding the above common applications of the various dispenser apparatuses currently on the market, the present inventors herein have discovered that another application of a dispenser apparatus is in the hairstyling profession. Hair colouring, hair perming, hair straightening and the like are popular treatment process. The chemical products used for these applications are commonly available in squeezable and collapsible tubes. The inventors herein have discovered that there is a need for a dispenser apparatus to dispense such chemical products from such squeezable and collapsible tubes, particularly in hair salons, spas, and the like.

Hair care products of this type are generally very costly;—particularly if they are professional hair products. As such, theft of these products by customers and employees in salons are surprisingly frequent occurrences. As most salons are often times filled with customers and a full staff of hairstylists, such illegitimate practices become very difficult for the salon owners to monitor. Furthermore, these squeezable and collapsible tubes are usually quite small in size since the amount of chemicals contained therein is typically only suitable for a small number of treatments of a customer's hair. Accordingly, the squeezable and collapsible tubes are easily pocketed and stolen by both customers and employees at the salons. Potentially, many salon owners are at risk of losing thousands of revenues each year to such thefts.

Although locking the hair products in a secure enclosure is one way of preventing theft from customers, it is very inconvenient to the hairstylists who want to have immediately access to the hair products. If the products were locked away in storage, before treatment of a customer's hair, the hairstylists would have to request a key, the secure passcode, or the like, to unlock the enclosure to access the hair products contained therein. After obtaining the particular hair products from the enclosure, the hairstylists would have to lock the enclosure back in place. Since most hairstylists have very tight schedules over the course of the day at the salons, they may sometimes forget to lock the enclosure after removing the hair products from the secure enclosure. As such, there is still the potential for customers and other employees at the salon to have access to the enclosure. Further, in some circumstances, the hairstylists may need to obtain more hair products during treatment of a customer's hair, and having quick access to the hair products from such secure enclosure would be even more inconvenient.

The present inventors herein have provided a dispenser apparatus for squeezable and collapsible tubes which overcomes at least one of the disadvantages described above. In one preferred embodiment, the dispenser apparatus of the present invention has a storage portion which is dimensioned to receive a plurality of squeezable and collapsible tubes therein, and a dispensing portion integrally formed with such a storage portion. When the dispenser apparatus is in use, a single squeezable and collapsible tube is fed from the storage portion into the dispensing portion. The dispenser apparatus is structured such that the squeezable and collapsible tube is only easily removable from the dispensing portion after the material contained in the squeezable and collapsible tube has been substantially completely dispensed therefrom.

2. Description of the Prior Art

A number of patents which describe various kinds of dispenser apparatus are known to the inventors herein. They included the following:

U.S. Pat. No. 5,957,334 issued on Sep. 28, 1999 to Rosario teaches a toothpaste dispensing apparatus having a housing unit, a dispensing unit slidably disposed within the housing unit, and a closure unit hingedly connected to the housing unit. In use, the mouth of the toothpaste tube is engaged in a plate element slidably disposed within the housing unit. The closure unit cooperates with the dispensing unit to provide a double seal arrangement to maintain the contents of the toothpaste tube.

U.S. Pat. No. 3,701,459 issued on Oct. 31, 1972 to Ward teaches a tube paste squeezer adaptable for being mounted to a vertical wall. The device is particularly used for dispensing either toothpaste or shaving cream. The tube paste squeezer comprises a case within which the tube is fitted so as to be fed between a pair of rollers. A pivotable closure seal is adaptable for positioning against the inverted mouth of the tube. The seal includes a flat plate. To dispense the paste from the tube, the user pivots the seal plate away from the mouth of the tube and manually rotates the crank handle. This causes the tube to move slightly upwardly between the rollers so as to cause a quantity of the paste to be dispensed. Thereafter, the seal is pivoted to a closed position again over the mouth of the tube.

U.S. Pat. No. 3,908,863 issued on Sep. 30, 1975 to White teaches a collapsible tube dispenser for toothpaste and similar materials packaged in a collapsible tube. The dispenser comprises a generally wedge-shaped housing member defined by a pair of side walls which flare apart from a bottom end to a top end. The housing further includes a pressure plate, where one end of the plate is pivotably mounted to the housing adjacent the bottom end, and the other end of the plate being freely positioned at the top end of the housing. A threaded member extends through an opening in the housing. When the threaded member is rotated, the pressure plate abuts the collapsible tube to cause the material in the tube to be dispensed through the opening at the top of the housing. When the dispenser is not in use, a hinged cover encloses the top opening of the housing.

U.S. Pat. No. 4,271,985 issued on Jun. 9, 1981 to Andersen teaches an apparatus for dispensing a fluid substance from a flexible container. The apparatus comprises of two opposed plates which are pivotably attached to a frame, and which receive the container therebetween. The plates are movable relatively to one another with the aid of a suitable linkage so as to compress the container between the plates, causing a dose of the substance within the container to be dispensed.

U.S. Pat. No. 5,71 1,455 issued on Jan. 27, 1998 to Elliott teaches a tube product dispenser adapted to incrementally squeeze a viscous liquid product from a flexible tube-type reservoir. The device includes a tubular outer housing, a tubular inner housing having a pair of flexible compressor bands therein, and a roller assembly which is engaged to a helical screw thread on the inner housing. The flexible tube-type reservoir is inserted between the pair of flexible compressor bands. Movement of the roller assembly is achieved by manually rotating a bottom-located handle that is fixed to the inner housing. When the inner housing rotates, the roller assembly travels up or down along the length of the bands. As the roller assembly moves along the bands in a direction toward the tube's outlet, it squeezes the bands together. As the bands push toward each other, pressure is exerted on the sides of the tube, causing the tube's contents to be expelled.

U.S. Pat. No. 3,915,342 issued on Oct. 28, 1975 to Van Bussel teaches a tube dispenser having control means for dispensing the contents of the tube. The dispenser includes a housing within which the tube is placed, a slide movable longitudinally in the housing, and at least one squeeze member in the housing. The squeeze member is disposed between and generally parallel to the arms of the slide, at a side of the tube inside the housing. The dispenser has control means which connects the slide with the squeeze member such that in response to a longitudinal movement of the slide, the squeeze member deforms the tube, causing it to collapse, and thus expel the contents of the tube.

U.S. Pat. No. 5,105,984 issued on Apr. 21, 1992 to Kazimir teaches a paste tube dispenser and a method for making such a dispenser. The dispenser includes a support member, a cover member, and a chamber disposed between the support member and the cover member. The paste tube is placed in the chamber when in use. The support member and the cover member have respective resilient liners for snugly holding the tube within the chamber. Further, the support member is connected to the cover member by hinge means. By pressing on the cover member, a portion of the paste is expelled from the paste tube.

U.S. Pat. No. 4,418,840 issued on Dec. 6, 1983 to Gardner, Sr. teaches an automatic toothpaste dispenser for dispensing a predetermined amount of semi-fluid contents from a tube, such as toothpaste from a toothpaste tube. The dispenser is electrically operated and it comprises a housing for holding the tube in a position such that the opening of the tube extends downwardly, an arrangement for slidably closing the end of the opening in the tube, an agitator for inducing the flow of the semi-fluid contents in the tube upon manual command, and means for withdrawing the slidable closing means from the opening upon manual command so as to permit the semi-fluid material to flow out of the tube.

U.S. Pat. No. 4,607,763 issued on Aug. 26, 1986 to Wright teaches a dispenser for metering the dispensing of toothpaste from a collapsible tube. The dispenser includes rollers movably mounted in a housing for squeezing a tube, as the rollers roll axially along the length of the tube.

Finally, U.S. Pat. No. 3,910,460 issued on Oct. 7, 1975 to Hausmann et al. teaches a device for holding and squeezing tubes. The device includes a relatively rigid housing, and a turning key. The housing is provided with a squeeze-out slit. The turning key is to be inserted into an opening in the housing, parallel to this slit. The opening which extends through the housing is wider than the thickness of the key such that the key fits into the opening when the tube is rolled up on it.

SUMMARY OF THE INVENTION

In accordance with one aspect of the present invention, there is provided a dispenser apparatus for dispensing a material from a squeezable and collapsible tube, which tube has a first closed end and a second end having a mouth, and which tube is structured in such a manner that when a portion of said tube has been compressed, that at least a portion of said tube remains in the compressed state, said dispenser apparatus comprising:

- a housing unit having a front wall, a rear wall, first and second side walls, a bottom plate having an opening defined therein, a top end, a bottom end, and a longitudinal axis extending from said top end to said bottom end;
- a storage portion, within said housing, having a first end through which squeezable and collapsible tubes can be added to said storage portion, and a second end through which squeezable and collapsible tubes can exit said storage portion, and having storage room for at least one squeezable and collapsible tube;
- a dispensing portion having:
  - a first end and a second end, wherein said first end of said dispensing portion is operatively connected with said second end of said storage portion so that a squeezable and collapsible tube can be moved from said storage portion to said dispensing portion;
  - a dispensing means in the region between said storage portion and said dispensing portion in said housing unit, which dispensing means is capable of moving a squeezable and collapsible tube from said storage area to said dispensing area;
  - a compressing member which, when in use, is located at least partially within said dispensing portion of said housing unit; and
  - a port defining an opening on the front wall of said housing, at said second end of said dispensing portion;
- wherein when said squeezable and collapsible tube is in said dispensing portion, it is oriented such that the mouth of the squeezable and collapsible tube is aligned with said opening in said bottom plate of said housing unit;
- whereby when said dispenser apparatus is in use, said compressing member compresses said squeezable and collapsible tube so as to dispense the material from the squeezable and collapsible tube through its mouth, and transform said squeezable and collapsible tube from a full shape to a collapsed shape; and wherein said port is dimensioned to have a size similar to said collapse shape so that only a squeezable and collapsible tube in a collapsed shape may be removed from said dispensing portion through said port.

Preferably, a number of the dispenser apparatus described hereinabove, with respect to the present invention, can be combined into a single unit. As such, in a preferred embodiment, the present invention also provides a dispensing system apparatus for dispensing materials from a plurality of squeezable and collapsible tubes, comprising a plurality of dispenser apparatuses as described hereinabove, wherein said dispenser apparatuses have been joined together in a contiguous relationship.

DETAILED DESCRIPTION OF THE INVENTION

The dispenser apparatus of the present invention is useful for controlling the inventory of, and the dispensing of materials from squeezable and collapsible tubes. The materials dispensed can be any of the materials described above with respect to the prior art. Preferably, however, the dispensed material is a paste or other product used for hair treatment. Most preferably the material is a dye for hair.

The dispenser apparatus is designed for use for dispensing material from a squeezable and collapsible tube. These squeezable and collapsible tubes have a first closed end, and a second end having a mouth, and can be manufactured from a wide variety of materials. While not essential, the squeezable and collapsible tube is preferably manufactured from a material such that when a portion of the squeezable and collapsible tube has been compressed, that portion of the squeezable and collapsible tube remains in a compressed or collapsed shape. However, the tube can remain in the compressed or collapsed state as a result of continued pressure, or can be permanently "deformed" into the compressed or collapsed shape.

As such, the squeezable and collapsible tube is structured in such a manner that when a portion of the squeezable and collapsible tube has been compressed, that portion of the squeezable and collapsible tube preferably remains in the compressed state. This could include, for example, maintaining an empty, coiled shape, or a flattened, empty shape.

The dispenser apparatus has a housing unit having a front wall, a rear wall, first and second side walls, a bottom plate having an opening defined therein, a top end, a bottom end, and a longitudinal axis extending from the top end to the bottom end. The housing, and all other components of the dispenser apparatus and/or dispensing system, can be manufactured from any suitable materials providing adequate strength properties. These materials can include products such as ferrous or non-ferrous metals such as steel or aluminum, but might also include materials such as plastics, ceramics, wood, paper, cardboard, or the like, or combinations thereof or therebetween. The material(s) selected will preferably provide protection from theft or other misuse, while providing a light product with acceptable appearance.

The dispenser apparatus includes a storage portion for holding at least one squeezable and collapsible tube, within said housing having a first end, through which said tubes can be added to said storage portion, and a second end, through which said tubes can exit said storage portion. The storage portion preferably defines the region of the top end of the housing unit.

Preferably, the dispenser apparatus of the present invention has a storage portion which is dimensioned to receive a plurality of squeezable and collapsible tubes therein, which preferably rest in a horizontal position.

Still further, the dispenser apparatus includes a dispensing portion having a first end and a second end, wherein the first end of the dispensing portion is operatively connected with said second end of said storage portion so that a tube can move from the storage portion to the dispensing portion. The first end of the dispensing portion is preferably integrally formed with the second end of the storage portion, and preferably defines a portion of the region at the bottom end of the housing unit. As such, the dispensing portion is integrally formed with the storage portion.

The dispensing portion preferably only accommodates one squeezable and collapsible tube at a single time. The squeezable and collapsible tube in the dispensing portion is oriented such that the mouth of the squeezable and collapsible tube is aligned with the opening of the bottom plate of the housing unit.

The dispenser apparatus also has a dispensing means so that when the dispenser apparatus is in use, a squeezable and collapsible tube is fed from the storage portion into the dispensing portion by use of the dispensing means. In some instances, the dispensing means might simply be gravity or some other biasing means which would cause a tube to move to the dispensing portion once an empty, compressed tube had been removed. Preferably, however, the dispenser apparatus provides a dispensing member for allowing or preventing tubes from moving from the storage portion to the dispensing portion. The dispensing means is typically, and preferably, located in the region between the storage portion and the dispensing portion and is capable of moving a tube from said storage area to said dispensing area.

However, the dispensing member can be any suitable device for moving, or allowing movement, of the squeezable and collapsible tube from the storage portion. This might include, for example, a robotic arm or the like for moving a squeezable and collapsible tube from storage to the dispensing portion. Preferably, however, the dispensing member is a flat or curved bar which prevents a squeezable and collapsible tube from exiting the storage portion. When the dispensing member is in an open position, passage of one squeezable and collapsible tube from the storage portion to the dispensing portion is permitted. When the dispensing member is in a closed position, passage of any squeezable and collapsible tube from the storage portion to the dispensing portion is precluded. Movement of the dispensing member from the closed to the open position can be effected electronically with an electric motor, solenoid, or the like, hydraulically, or by simple movement of a lever or other device, by hand.

In a preferred embodiment, the dispensing member is a rotatable, trough-shaped plate which is disposed substantially perpendicular to the longitudinal axis of the housing unit. The rotatable plate can also define the second end of the storage portion.

In a preferred design, one full squeezable and collapsible tube will fit into the trough of the trough-shaped dispensing member. By rotation of the trough-shaped dispensing member, the tube contained in the member can fall from the storage portion to the dispensing portion. However, as the trough-shaped member rotates, it prevents additional tubes from the storage portion from moving into the dispensing portion. When the first tube has fallen, and the trough-shaped member returned to its original position, a second tube can now fall into the trough, for release when the rotating dispensing member is again rotated.

The dispensing portion also preferably comprises a feeder plate for delivering the full squeezable and collapsible tube from the storage portion to its proper position within the dispensing portion. The feeder plate has a first end and a second end. The first end of the feeder plate is preferably downwardly sloping from one of the rear wall towards the front wall. The feeder plate is preferably located underneath the dispensing member, and is preferably located in the region between the storage portion and the dispensing portion. The second end of the feeder plate can extend down into the dispensing portion to form one wall of the housing.

In one preferred embodiment of the invention, the upper end of the feeder plate defines the second end of the storage portion. In the area at the lower end of the dispensing portion, however, the feeder plate is substantially vertical, and essentially flat.

In a more preferred embodiment of the invention, the feeder plate has a convex shape, such that the tube, which is preferably in a horizontal position when it enters the dispensing portion, slides down the feeder plate, and ultimately ends up in a vertical position at the bottom of the dispensing portion, and is in position for the cap to be removed, and material to be dispensed from the tube.

The dispensing portion also comprises a compressing member. The compressing member—which can any of a variety of means in which to compress the squeezable and collapsible tube—, at least when in use, is preferably at least partially located in the dispensing portion of the housing unit. The compressing member may be a set of plates which squeeze the tube between them, or more preferably, is a slotted key which can be fitted over the closed end of the squeezable and collapsible tube, and rotated to cause the squeezable and collapsible tube to form a coil around the key, and force the material from the open end of the tube. The compressing member is located within the dispensing portion, although a portion of the compressing member can extend outside of the housing (e.g. the end of the slotted key).

When the dispenser apparatus is in use, the compressing member presses against the body of the squeezable and collapsible tube in a progressive squeezing and compressing action from the closed end of the squeezable and collapsible tube towards the mouth of the squeezable and collapsible tube so as to dispense the material from the squeezable and collapsible tube through its mouth. As the compressing member acts on the tube, the tube collapses, and transforms from a full shape to a collapsed shape. When substantially completely empty, the collapsed tube can be removed from the port, and a new, full tube can be allowed to move into the dispensing portion. The collapsed tube will preferably have either a coiled shape which can pass through a square opening (or the like), or a flattened shape which can pass through a slotted opening.

Typically, but not necessarily, the compressing member is chosen from the group consisting of rollers, pressure plates, keys, and combinations thereof.

The dispensing portion also comprises a port, defining an opening on a wall of the housing, through which a substantially completely collapsed tube can be removed. The port is preferably located on a lower section of the front wall of the housing, and the dispenser apparatus is structured such that the squeezable and collapsible tube is only easily removable from the dispensing portion, through the port, only after the material contained in the squeezable and collapsible tube has been substantially completely dispensed therefrom.

Accordingly, the port is preferably sized so that the empty, collapsed tubes can be easily removed from the housing. For an empty, collapsed tube having a coiled shape, a rectangular opening having a height and width greater than the diameter of the coiled, collapsed tube shape, would be suitable. For an empty, collapsed tube have a flattened shape, a slot in the front of the dispensing portion could be provided which would be just large enough to allow the flattened, empty tube to slide through the opening. The slot would be sized, however, so that a full tube would not be able to pass through the opening.

The port is dimensioned in such a manner that only after the material contained in the squeezable and collapsible tube, has been substantially completely dispensed therefrom, and thus the tube has taken on a collapsed shape, is the tube removable from the port. The port is preferably positioned so that the collapsed tube can be removed by pulling the tube in an outward direction through the port.

In an additional feature, the front of the dispensing portion may also contain an upper opening into which a slotted key, which would act as the compressing member, could be inserted into the dispensing portion to coil the squeezable and collapsible tube. The upper opening would facilitate access to the end of the full squeezable and collapsible tube when it was located within the dispensing portion. The dispensing portion might also preferably comprise a slot extending from this upper opening to the port, through which the end of the key can move, as the tube is coiled.

The dispensing portion can be sized so that the squeezable and collapsible tube will fit snugly in position when product is dispensed. However, it is preferred that a small gap be provided to allow the tube to fall correctly into place, and to allow for some change in width as the tube is coiled.

However to hold the tube in the correct position, it is preferred that the dispenser apparatus further comprise a grasping means in the region around the opening defined in the bottom plate so as to hold the squeezable and collapsible tube in position in the dispensing portion of the housing unit. The grasping means may simply be a set of protrusions on the inner sides of the walls of the housing in the area of the mouth of the tube. The tube can then be forced between the protrusions, and held in place by a snug, friction fit produced by the protrusions pressing on the sides of the tube.

When the squeezable and collapsible tube falls into position in the dispensing portion, the mouth of the tube is aligned with the opening in the bottom plate of the housing unit. This allows the material within the tubes to leave the dispensing portion whenever the tube is compressed. The tube can also partially extend through the opening, but the opening should be sized so as to prevent the removal of the entire tube through this opening.

In a further embodiment, the dispenser apparatus may further also comprise a receiving plate which can be integrally formed with, or removably attached to, the bottom end of the housing unit. A receiving vessel can then be placeable thereon for receiving the material dispensed from the squeezable and collapsible tube.

In yet another further embodiment, the dispenser apparatus further comprises at least one lockable cover plate. The lockable cover plate can substantially cover most of the housing unit in such a manner that the opening in the bottom plate of the dispensing portion is unobstructed, and when the lockable cover plate is in a locked position, the plurality of squeezable and collapsible tubes in the housing unit are inaccessible. Most preferably, however, the housing has at least two lockable cover plates. One lockable plate will cover the front or top of the storage portion, and can be unlocked by the person who is responsible for adding additional squeezable and collapsible tubes to the dispenser apparatus. The second lockable cover will cover the area adjacent the feeder plate. As such, easily access to the housing can be provided in situations where a tube might jamb as it falls from the storage portion.

Overall it should be noted that the dispenser apparatus is preferably structured in such a manner that there is at least one channel extending vertically in the housing unit from the top end to the bottom end. The channel is dimensioned so as to receive a plurality of squeezable and collapsible tubes therein, in the storage portion, and to hold at least one squeezable and collapsible tube as it slides down the feeder plate to fall into position in the dispensing portion.

In a preferred feature, the dispenser apparatus can be placed in side-by-side relationship with additional dispenser apparatuses, to provide a plurality of parallel, vertical channels, and thus form a dispenser system. Using the dispenser system, a variety of different products (e.g. different colours of dyes) can be provided in a single unit. The dispenser system can be manufactured by attaching individual dispenser apparatuses together, but preferably is formed so that the different dispenser apparatuses share common walls, or the like.

BRIEF DESCRIPTION OF THE DRAWINGS

The novel features which are believed to be characteristic of the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only and are not intended as a definition of the limits of the invention. Embodiments of this invention will now be described by way of example in association with the accompanying drawings in which.

DETAILED DESCRIPTION OF THE PREFERRED EMBODIMENTS

The novel features of a currently preferred embodiment of the present invention, and which are believed to be characteristic of the present invention, as to its structure, organization, use and method of operation, together with further objectives and advantages thereof, will be better understood from the following discussion.

Figure 1:
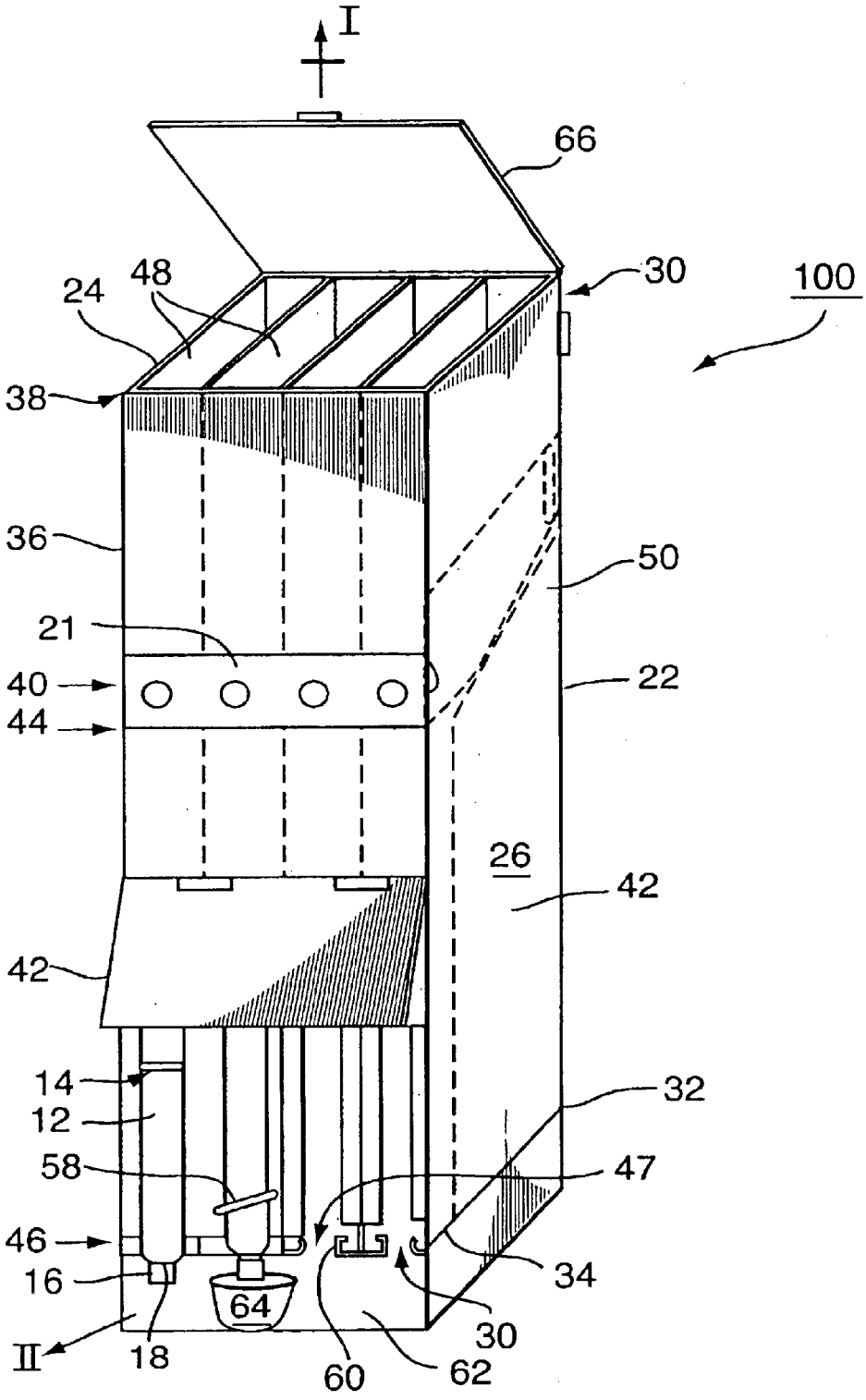
FIG. 1 is a perspective view of a first embodiment of a dispenser apparatus in keeping with the present invention.
Figure 2:
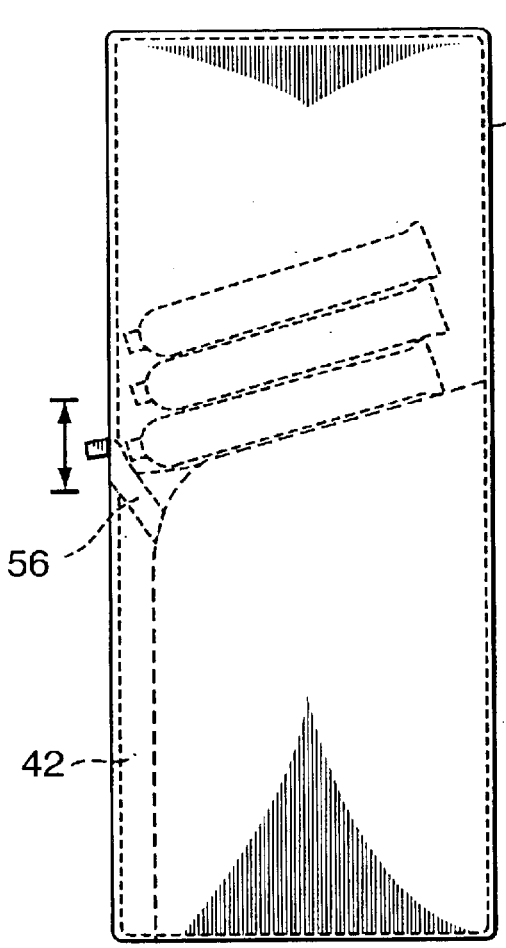
FIG. 2 is a side elevation view of a first embodiment of a dispenser apparatus in keeping with the present invention.
Figure 3:
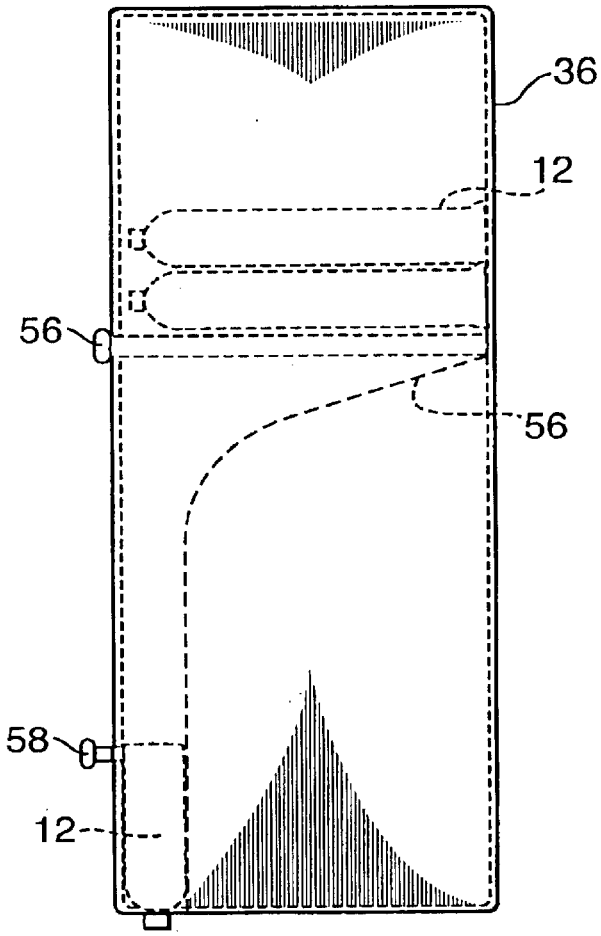
FIG. 3 is a side elevation view of a second embodiment of a dispenser apparatus in keeping with the present invention.

A first embodiment of the dispenser apparatus 100 in keeping with the present invention is shown in FIGS. 1 to 4. The dispenser apparatus 100 is fabricated from steel and is used to dispense materials from a squeezable and collapsible tubes, all of which are identified by common reference number "12". As can be seen in FIG. 2, each squeezable and collapsible tube 12 has a first closed end 14 and a second end 16 with a mouth 18. The squeezable and collapsible tube 12 is manufactured from aluminum foil, and is structured in such a manner that when a portion of tube 12 has been compressed, that portion of tube 12 remains in the compressed state.

The dispenser apparatus 100 has a housing unit 20 which comprises a front wall 21, a rear wall 22, first and second side walls 24 and 26 respectively, and a bottom plate 34. The housing unit 20 has a top end 30, a bottom end 32, and a longitudinal axis as shown by arrow I, extending from the top end 30 to the bottom end 32. Bottom plate 34 has an opening 31 defined therein.

The region of the top end 30 of the housing unit 20 is defined as the storage portion 36 which has a first end 38 and a second end 40. The region of the bottom end of the housing unit 20 is defined as the dispensing portion 42 which has a first end 44 and a second end 46. The first end 44 of the dispensing portion 42 is integrally formed with the second end 40 of the storage portion 36. It is important to note that the housing unit 20 has a port 47 at the second end 46 of the dispensing portion 42. As shown in FIG. 1, the dispenser apparatus 100 has four channels 48 extending vertically in the housing unit 20 from the top end 30 to the bottom end 32. Each channel 48 is dimensioned so as to receive a plurality of squeezable and collapsible tubes 12 therein.

Furthermore, in each of the at least one channel 48 in the housing unit 20, a feeder plate 50 is situated in the region between the storage portion 36 and the dispensing portion 42. As can be particularly seen in each of the side elevation views of the first embodiment of the dispenser apparatus 100 (FIG. 2) and the second embodiment of the dispenser apparatus 200 (FIG. 3) of the present invention, the feeder plate has a first end and a second end 52 and 54 respectively. The first end 52 of the feeder plate 50 downwardly slopes from one of the rear wall 22, towards the front wall 21, in the region of the second end 40 of the storage portion 36 towards the dispensing portion 42. As shown in both FIGS. 2 and 3, the first end 52 of the feeder plate 50 downwardly slopes from the front wall 21 of the storage portion 36 towards the dispensing portion 42.

Still further, a dispensing member 56 is disposed above the first end 52 of the feeder plate 50. The dispensing member 56 is in the region between the storage portion 36 and the dispensing portion 42 of each of the channels 48 in the housing unit 20. A knob 57 is attached to dispensing member 56, and is used to rotate dispensing member 56.

At least when the dispensing apparatus 100 is in use, a compressing member 58, being a slotted key with a handle, is located in the dispensing portion 42 of the housing unit 20.

It can be seen that the dispensing portion 42 accommodates one squeezable and collapsible tube 12 at a single time. The squeezable and collapsible tube 12 in the dispensing portion 42 is oriented such that the mouth 18 of the squeezable and collapsible tube 12 is aligned with the opening 31 of the bottom plate 34 of the housing unit 20. In the storage portion 42 of the housing unit 20, however, the squeezable and collapsible tubes 12 are stacked one on top of the other, in such a manner that the sealed cap of each of the squeezable and collapsible tubes are outwardly facing towards the front wall 21 of the housing unit 20.

It is important to note that the port 47 is dimensioned in such a manner that after the material contained in the squeezable and collapsible tube 12 has been completely dispensed therefrom, the squeezable tube is removable from the port in an outward direction as shown by arrow II in FIG. 1.

When the dispenser apparatus 100 of the present invention is in use, the compressing member 58 presses against the body of the squeezable and collapsible tube 12 in a progressive squeezing and compressing action from the closed end 14 of the squeezable and collapsible tube 12 towards the mouth 18 of the squeezable and collapsible tube so as to dispense the material from the squeezable and collapsible tube through its mouth 18.

In a preferred embodiment of the dispenser apparatus 100 of the present invention, the feeder plate 50 has a convex shape, and the dispensing member 56 is a rotatable plate. The rotatable plate is disposed substantially perpendicularly to the longitudinal axis I of the housing unit 20. Further, the rotatable plate 56 defines the second end 40 of the storage portion 36.

The dispensing apparatus of the present invention further comprises grasping means 60 in the region around the opening 31 defined in the bottom plate 34 so as to hold the squeezable and collapsible tube 12 in position in the dispensing portion 42 of the housing unit 20.

Typically, but not necessarily, the dispensing apparatus 100 of the present invention further comprises a receiving plate 62. The receiving plate 62 is removably attached to the bottom end 32 of the housing unit 20 such that a receiving vessel 64 is placeable thereon for receiving the material dispensed from the squeezable and collapsible tube 12. In many instances, the receiving vessel 64 is a bowl.

In order to provide a tamper—proof dispensing apparatus, the dispensing apparatus of the present invention may also comprise a lockable cover plate 66 as shown in FIG. 1. In this particular embodiment of the dispensing apparatus 100, the squeezable and collapsible tubes 12 are loaded from the top end 30 of the housing unit 12. The lockable cover plate 66 substantially covers the top of housing unit 12. When the lockable cover plate 66 is in a locked position, the plurality of squeezable and collapsible tubes in the housing unit are inaccessible. A second lockable cover plate 67 is shown which is used to gain access to the area between storage portion 36 and dispensing portion 42, should a tube become jammed, or the like.

In a second embodiment of the dispenser apparatus 100 of the present invention (FIG. 3), the one end of feeder plate 50A is substantially flat. In this embodiment, dispensing member 56A is essentially a lever which can be moved out of the way to open a passage to allow tube 12 to fall into the dispensing portion 42. When dispensing member 56A is in an open position, passage of one squeezable and collapsible tube 12 from the storage portion 36 to the dispensing portion 42 is permitted. When the dispensing member 56A is in a closed position, passage of any squeezable and collapsible tube 12 from the storage portion 36 to the dispensing portion 42 is precluded.

Figure 4:
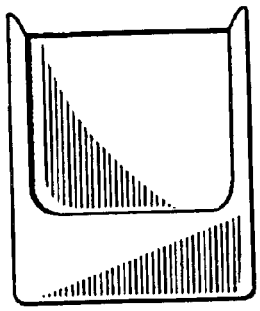
FIG. 4 is a top view of a grasping member of use in the present device.

Grasping member 60 is shown in more detail in FIG. 4, and merely comprises a "C"-shaped clip which is fitted into the lower end of the dispensing portion. The opening of member 60 is such that a friction fit with tube 12 can be provided.

Figure 5:
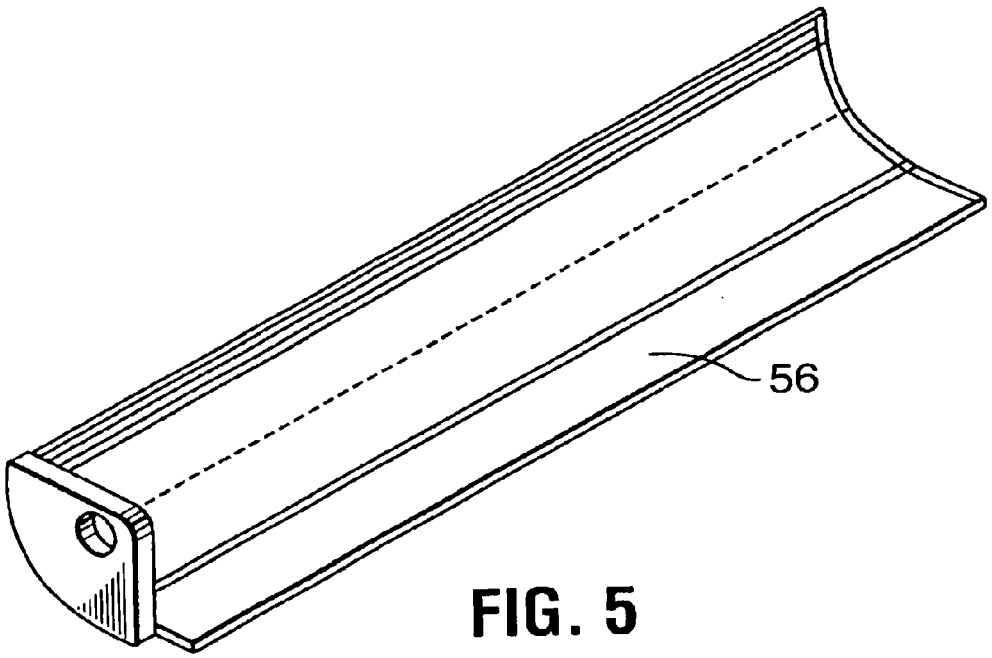
FIG. 5 is a perspective view of a preferred dispensing member.

Dispensing member 56 is shown in more detail in FIG. 5 and comprises a trough-shaped member which can be rotated using a knob 57 (not shown). The trough of member 56 is sized to hold one tube 12, and rotation of member 56 allows the one tube 12 to fall from the storage portion 36 to dispensing portion 42.

In keeping with the present invention, it will be understood that the dispenser apparatus is mountable on a vertical wall or placeable on a horizontal support surface.

Other modifications and alterations may be used in the design and manufacture of the dispenser apparatus of the present invention without departing from the spirit and scope of the accompanying claims.

Throughout this specification and the claims which follow, unless the context requires otherwise, the word "comprise", and variations such as "comprises" or "comprising", will be understood to imply the inclusion of a stated integer or step or group of integers or steps but not to the exclusion of any other integer or step or group of integers or steps.

Moreover, the word "substantially" when used with an adjective or adverb is intended to enhance the scope of the particular characteristic; e.g., substantially planar is intended to mean planar, nearly planar and/or exhibiting characteristics associated with a planar element.

What is claimed is:

1. A dispenser apparatus for dispensing a material from a squeezable and collapsible tube, which tube has a first closed end and a second end having a mouth, and which tube is structured in such a manner that when a portion of said tube has been compressed, that at least a portion of said tube remains in the compressed state, said dispenser apparatus comprising:

a housing unit having a front wall, a rear wall, first and second side walls, a bottom plate having an opening defined therein, a top end, a bottom end, and a longitudinal axis extending from said top end to said bottom end;

a storage portion, within said housing, having a first end through which squeezable and collapsible tubes can be added to said storage portion, and a second end through which squeezable and collapsible tubes can exit said storage portion, and having storage room for at least one squeezable and collapsible tube;

a dispensing portion having:

a first end and a second end, wherein said first end of said dispensing portion is operatively connected with said second end of said storage portion so that a squeezable and collapsible tube can be moved from said storage portion to said dispensing portion;

a dispensing means in the region between said storage portion and said dispensing portion in said housing unit, which dispensing means is capable of moving a squeezable and collapsible tube from said storage area to said dispensing area;

a compressing member which, when in use, is located at least partially within said dispensing portion of said housing unit; and a port defining an opening on the front wall of said housing, at said second end of said dispensing portion;

wherein when said squeezable and collapsible tube is in said dispensing portion, it is oriented such that the mouth of the squeezable and collapsible tube is aligned with said opening in said bottom plate of said housing unit;

whereby when said dispenser apparatus is in use, said compressing member compresses said squeezable and collapsible tube so as to dispense the material from the squeezable and collapsible tube through its mouth, and transform said squeezable and collapsible tube from a full shape to a collapsed shape; and wherein said port is dimensioned to have a size similar to said collapse shape so that only a squeezable and collapsible tube in a collapsed shape may be removed from said dispensing portion through said port.

2. A dispenser apparatus as claimed in claim 1 wherein said storage portion defines the region at the top end of said housing unit, and said dispensing portion defines the region at the bottom end of said housing unit.

3. A dispenser apparatus as claimed in claim 2 wherein said first end of said dispensing portion is integrally formed with said second end of said storage portion.

4. A dispenser apparatus as claimed in claim 2 wherein said storage portion and said dispensing portion form a vertical channel extending in said housing unit from said top end to said bottom end, each of said at least one channel being dimensioned so as to receive a plurality of squeezable and collapsible tubes therein.

5. A dispenser apparatus as claimed in claim 4 wherein said dispensing means comprises a feeder plate having a first end and a second end, said first end of said feeder plate being downwardly sloping from one of said walls in the region of said second end of said storage portion, towards said dispensing portion, and being a substantially vertical wall within said dispensing portion.

6. A dispenser apparatus as claimed in claim 5 wherein said dispensing means additionally comprises a dispensing member above said first end of said feeder plate, and in the region between said storage portion and said dispensing portion, in said channel in said housing unit, which moves a squeezable and collapsible tube from said storage area to said dispensing area.

7. A dispenser apparatus as claimed in claim 6 wherein when said dispensing member is in an open position, passage of one squeezable and collapsible tube from said storage portion to said dispensing portion is permitted, and wherein when said dispensing member is in a closed position, passage of any squeezable and collapsible tube from said storage portion to said dispensing portion is precluded.

8. A dispenser apparatus as claimed in claim 7 wherein said dispensing member is a trough shaped member extending substantially horizontally through said channel and substantially perpendicular to said longitudinal axis of said housing unit, on which member said squeezable and collapsible tubes rest while in said storage portion, and which member is rotatable to a position whereby a single squeezable and collapsible tube from said storage portion is allowed to fall onto said inclined plane, and then allowed to fall into said dispensing portion.

9. The dispenser apparatus of claim 1, wherein said feeder plate defines said second end of said storage portion, and wherein said feeder plate is substantially flat.

10. The dispenser apparatus of claim 1 wherein said dispensing portion accommodates one squeezable and collapsible tube at a single time.

11. The dispenser apparatus of claim 1, wherein said compressing member is chosen from the group consisting of rollers, pressure plates, keys, and combinations thereof.

12. The dispenser apparatus of claim 1 wherein only after the material contained in the squeezable and collapsible tube has been essentially completely dispensed therefrom, is the squeezable tube removable from dispensing portion, through said port.

13. The dispenser apparatus of claim 1, further comprising grasping means in the region around said opening defined in said bottom plate so as to hold the squeezable and collapsible tube in position in said dispensing portion of said housing unit.

14. The dispenser apparatus of claim 1, further comprising a receiving plate removably attached to said bottom end of said housing unit such that a receiving vessel is placeable thereon for receiving the material dispensed from the squeezable and collapsible tube.

15. The dispenser apparatus of claim 1, further comprising a lockable cover plate, wherein said lockable cover plate substantially covers the storage portion of said housing unit, and wherein when said lockable cover plate is in a locked position, the plurality of squeezable and collapsible tubes in said storage portion are inaccessible.

16. The dispenser apparatus of claim 15 further comprising a second lockable cover plate which covers at least a part of said dispensing portion.

17. The dispenser apparatus of claim 1 wherein said compressing member compresses said squeezable and collapsible tube in a progressive squeezing and/or compressing action from the closed end of the squeezable and collapsible tube towards the mouth of the squeezable and collapsible tube.

18. The dispenser apparatus of claim 1 wherein said port is rectangular in shape and is sized so that only a coiled, compressed squeezable and collapsible tube can be removed from said dispensing portion.

19. The dispenser apparatus of claim 1 wherein said port is a vertical slot on said front wall and is sized so that only a flat, compressed squeezable and collapsible tube can be removed from said dispensing portion.

20. The dispenser apparatus of claim 1 wherein openings are provided on at least a portion of said front wall in order that the contents within said housing unit may be viewed.

21. A dispensing system apparatus for dispensing materials from a plurality of squeezable and collapsible tubes, comprising a plurality of dispenser apparatuses as claimed in claim 1, wherein said dispenser apparatuses have been joined together in a contiguous relationship.

* * * * *